US008490342B2

(12) United States Patent
Greaves

(10) Patent No.: US 8,490,342 B2
(45) Date of Patent: Jul. 23, 2013

(54) BATTEN/JOIST SUPPORT

(75) Inventor: Henry Greaves, Watsons Bay (AU)

(73) Assignee: Alan Sian Ghee Lee, Singapore (SG)

( * ) Notice: Subject to any disclaimer, the term of this patent is extended or adjusted under 35 U.S.C. 154(b) by 272 days.

(21) Appl. No.: 12/527,369

(22) PCT Filed: Feb. 15, 2008

(86) PCT No.: PCT/AU2008/000208

§ 371 (c)(1),
(2), (4) Date: Nov. 2, 2009

(87) PCT Pub. No.: WO2008/098313

PCT Pub. Date: Aug. 21, 2008

(65) Prior Publication Data

US 2010/0058679 A1 Mar. 11, 2010

(30) Foreign Application Priority Data

Feb. 16, 2007 (AU) ..... 2007900797

(51) Int. Cl.
*E04B 9/00* (2006.01)

(52) U.S. Cl.
USPC ... 52/126.5; 52/126.6; 52/126.7; 248/346.01; 248/349.1

(58) Field of Classification Search
USPC ..... 52/126.5, 126.6, 126.7, 263, 299, 52/272, 289, 713–715; 248/346.01, 346.02, 248/349.1, 354.1, 354.3, 343
See application file for complete search history.

(56) References Cited

U.S. PATENT DOCUMENTS

| | | | | | |
|---|---|---|---|---|---|
| 1,772,494 | A | * | 8/1930 | New | 156/348 |
| 2,928,273 | A | * | 3/1960 | Rheinstein | 52/584.1 |
| 3,222,030 | A | * | 12/1965 | Thorpe | 254/100 |
| 3,742,671 | A | * | 7/1973 | Ellis | 52/507 |
| 3,914,914 | A | * | 10/1975 | Jureit et al. | 52/632 |
| 4,058,047 | A | * | 11/1977 | Kramer et al. | 411/478 |
| 4,759,660 | A | * | 7/1988 | Corbett | 405/7 |

(Continued)

FOREIGN PATENT DOCUMENTS

EP 0 362 718 2/1992

*Primary Examiner* — Basil Katcheves
*Assistant Examiner* — Joshua Ihezie

(57) ABSTRACT

A support means (100) for engaging a batten, joist or the like (200), includes a circular rotatable plate (110). The plate has depending legs (112) for engaging the support means with a support structure such as a pedestal jack or the like, in a manner which allows the support means to be rotated about a vertical axis passing through the centre (111) of the plate. The support means (100) further includes two opposed upstanding walls (120, 122) defining a gap for receiving the batten, joist or the like. The walls are disposed either side of the axis and extend from a centermost position closest to the axis (111) to a distal end farthest from the axis. The walls are at least partly convex, and the gap between the walls measured in a direction perpendicular to tangents to the walls decreases from the centermost part of the wall to the distal end of the wall, so that for a joist batten or the like having a predetermined width and positioned between the walls (120, 122), rotation of the support means about the axis in one sense causes the walls (120, 122) to tend to abut edges of the joist and in the opposite sense causes the walls (120, 122) to tend to move away from the edges of the joist. The walls define apertures (129) for fastening the walls to the joist with nails, screws or the like.

11 Claims, 9 Drawing Sheets

U.S. PATENT DOCUMENTS 4,780,571 A 10/1988 Huang
4,870,789 A * 10/1989 Clark et al. ..... 52/126.6
4,908,915 A * 3/1990 Ruggles et al. ..... 24/336
4,982,539 A 1/1991 Hiller
5,107,641 A * 4/1992 Davis ..... 52/127.7
5,150,557 A * 9/1992 Gregory ..... 52/646
5,325,651 A * 7/1994 Meyer et al. ..... 52/715
5,442,885 A * 8/1995 Laven et al. ..... 52/844
5,467,566 A * 11/1995 Swartz et al. ..... 52/235
5,516,069 A * 5/1996 Hanna ..... 248/354.3
5,561,950 A * 10/1996 Collins et al. ..... 52/126.6
5,590,494 A * 1/1997 Miller ..... 52/169.9
5,816,554 A * 10/1998 McCracken ..... 248/346.01
5,819,482 A * 10/1998 Belke et al. ..... 52/126.6
6,094,873 A * 8/2000 Hoffman et al. ..... 52/126.6
6,324,800 B1 * 12/2001 Valentz et al. ..... 52/298
6,332,292 B1 * 12/2001 Buzon ..... 52/126.6
6,355,883 B1 * 3/2002 Gretz ..... 174/58
D465,722 S * 11/2002 Shijyo ..... D8/356
6,634,612 B1 * 10/2003 Shin et al. ..... 248/346.01
6,663,070 B2 * 12/2003 Valentz et al. ..... 248/354.1
6,677,523 B1 * 1/2004 Gretz ..... 174/63
6,799,408 B2 * 10/2004 Brady ..... 52/210
6,820,379 B1 * 11/2004 Krinner et al. ..... 52/157
6,832,746 B2 * 12/2004 McCracken et al. ..... 248/357
7,140,156 B1 * 11/2006 Lowe et al. ..... 52/263
7,307,214 B1 * 12/2007 Gretz ..... 174/58
7,635,066 B2 * 12/2009 Harrison ..... 220/503
2002/0121583 A1 * 9/2002 Jones et al. ..... 248/346.01
2002/0125395 A1 * 9/2002 Valentz et al. ..... 248/354.1
2002/0148173 A1 * 10/2002 Kugler ..... 52/126.6
2003/0222191 A1 * 12/2003 Tsai ..... 248/354.1
2004/0084596 A1 * 5/2004 Valentz et al. ..... 248/354.1
2004/0163334 A1 * 8/2004 Carlson ..... 52/126.6
2004/0261329 A1 * 12/2004 Kugler et al. ..... 52/126.6
2005/0055925 A1 * 3/2005 Johansson ..... 52/390
2006/0061136 A1 * 3/2006 Pines ..... 296/186.1
2009/0071084 A1 * 3/2009 Johansson ..... 52/263
2011/0232208 A1 * 9/2011 Tabibnia ..... 52/126.6

* cited by examiner

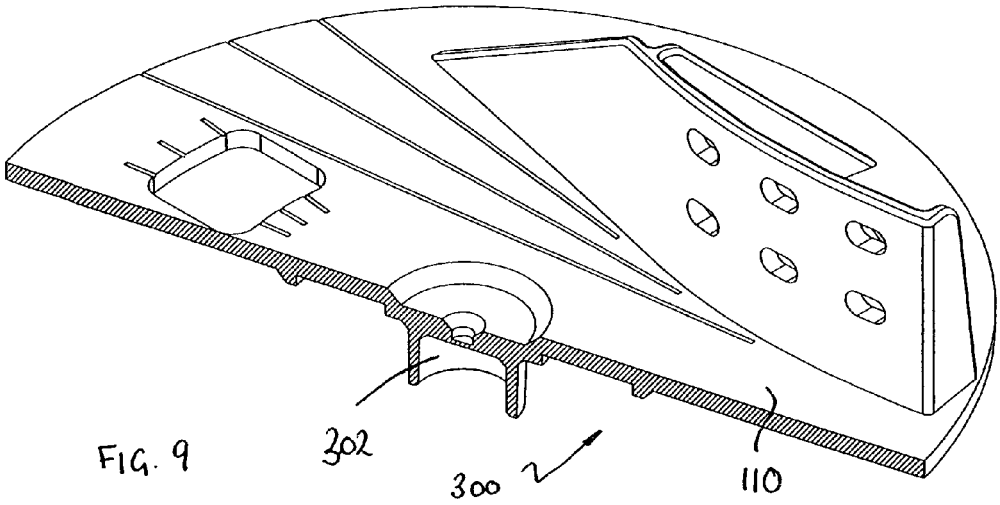
FIG. 9
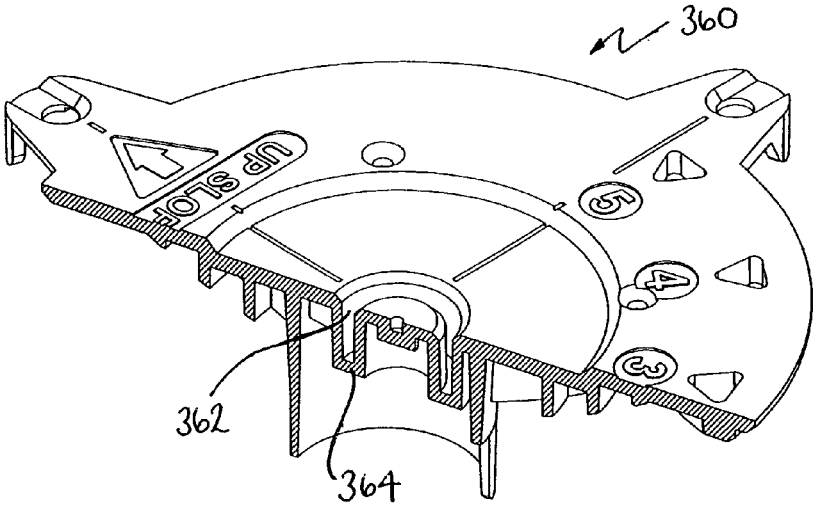

BATTEN/JOIST SUPPORT

FIELD OF THE INVENTION

This invention relates to an improved batten/joist support, particularly, but not exclusively, for raised floors.

BACKGROUND OF THE INVENTION

It is known to provide floors raised above a sub-floor comprising boards assembled on a framework comprising joists or battens, with the boards connected to the joists by means of coupling members. Typically, the sub-floors will be concrete. The boards are often made from wood or wood based composite materials, although other materials may be used. The joists are often mounted on height and slope adjustable pedestal supports, (also known as pedestal jacks) particularly where the sub-floor is sloping, to ensure that the raised floor is substantially horizontal. An example of an adjustable pedestal jack is shown in international patent application No PCT/AU2006/001613.

When such raised floors are mounted on pedestal jacks, a mounting component is typically provided for mounting the joist the top of such pedestal support. That mounting typically comprises a plate defining two opposed upstanding walls which are spaced apart at a distance equal to the expected width of the joist. The joist is typically secured to the mounting by nails extending through apertures in the walls into the joist.

However, there are a number of problems in using such mountings. The first problem is that the mounting is sized to suit the width of the joist. Therefore if the joist is oversized in width, the joist will not fit securely between the two walls of the mounting.

Secondly, even if the width of the joist does match the gap defined between the walls of the mounting, the joists tend to be quite long and are supported by numerous pedestals each carrying their own support. The supports have to be correctly aligned in order to receive the joist, and it is very time consuming to align the supports sufficiently to fit the joists.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

SUMMARY OF THE INVENTION

In a broad aspect, the present invention provides a device for engaging the sides of a joist batten or other member having a, typically constant, predetermined width including a rotatable plate defining two spaced apart upstanding walls wherein the device may be positioned with the member located between the walls in one relative orientation where the walls do not touch the sides of the member and wherein rotation of the device relative to the member, causes the walls to abut the sides of the member.

In one aspect of the present invention, there is provided a support means for engaging a batten, joist or the like, the support means including a rotatable plate, and further defining means for engaging the support means with a support structure such as a pedestal jack or the like, in a manner which allows the support means to be rotated about an axis, the support means further including two opposed upstanding walls defining a gap therebetween for receiving the batten, joist or the like, the walls being disposed either side of the axis and extending from a centremost position closest to the axis to a distal end farthest from the axis, the walls being at least partly convex, wherein the gap between the walls measured in a direction perpendicular to tangents to the walls decreases from the centremost part of the wall to the distal end of the wall, so that for a joist batten or the like having a predetermined width and positioned between the walls, rotation of the support means about the axis in one sense causes the walls to tend to abut edges of the joist, and rotation in the opposite sense to tend to move away from the edges of the joist.

The convex portion may be curved. Alternatively, it may comprise a series of flats arranged to define a stepped curve.

The radius of the convex portion may be greatest at the distal end of the convex portion and least at the centremost portion. The radius may change continuously, or in a discontinuous stepped fashion.

The convex portions may include through apertures to receive fasteners such as nails, screws or the like.

Preferably each wall includes a straight portion which extends from the centremost portion of the convex portion in an opposite direction to the convex portion, the straight portions of each wall being parallel to each other.

Typically, the plate is generally circular.

The support means may define a plurality of legs for engaging the support means in the top of the support such as a pedestal jack.

In a related aspect, the present invention also may provide a raised floor comprising:

a plurality of raised pedestal jacks, or the like;

support means embodying the first aspect of the present invention disposed on the pedestal jacks; and and joists attached to and extending between the support means.

BRIEF DESCRIPTION OF THE DRAWINGS

A specific embodiment of the present invention will now be described, by way of example only, and with reference to the accompanying drawings in which:—

FIG. 9 is an exploded cross sectional view of the variant of FIG. 7 above a slope compensator defining an annular channel for receiving the depending spigot of the variant.

DETAILED DESCRIPTION OF PREFERRED EMBODIMENTS

Figure 1:
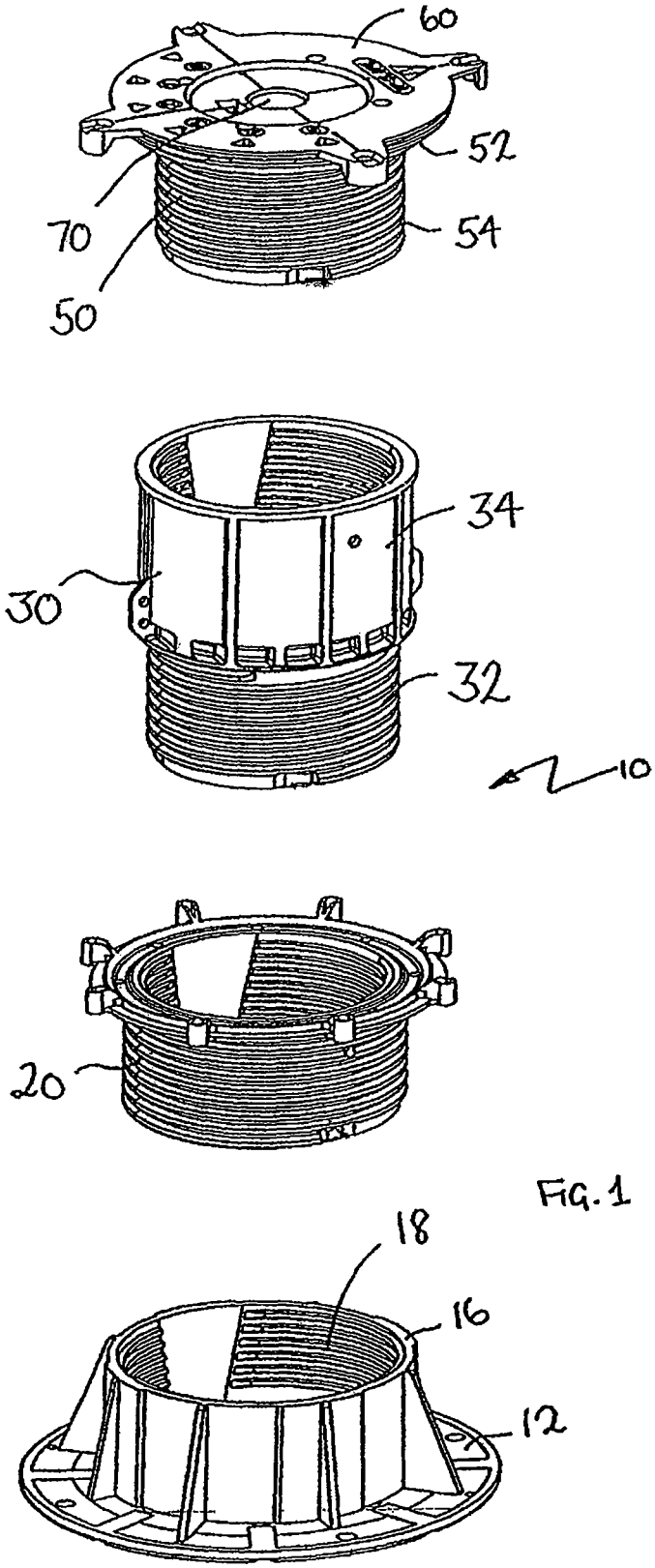
FIG. 1 is an exploded view of a typical adjustable pedestal jack.

Referring to the drawings, to provide a context for the invention, FIG. 1 shows a height adjustable pedestal 10 incorporating slope adjustment comprising a number of components. As shown, the height adjustable pedestal comprises a base element 12, having a circular planar base plate 14 defining a plane on which the pedestal stands in use, and an annular cylindrical portion 16 extending upwards from the base. The annular portion 16 is internally (female) threaded defining six internal threads 18. Spaced above the base 12 is a connector 20 which has an annular cross section and is internally and externally (male) threaded. The externally threaded portion locates in the base 16. Located above the connector 20 is an extender 30 which has a generally annular cross section comprising a lower portion 32 which is externally threaded and configured to locate inside the connector 20 and an upper, larger diameter portion 34 which is internally threaded. A head portion 50 includes an upper portion 52 and a depending externally threaded cylindrical portion 54. A slope compensator plate 60 locates on top of the upper portion of the head portion 50.

An aperture 70 having a circular cross-section and a depending circular wall is defined in the centre of the slope compensator plate 60.

Figure 2:
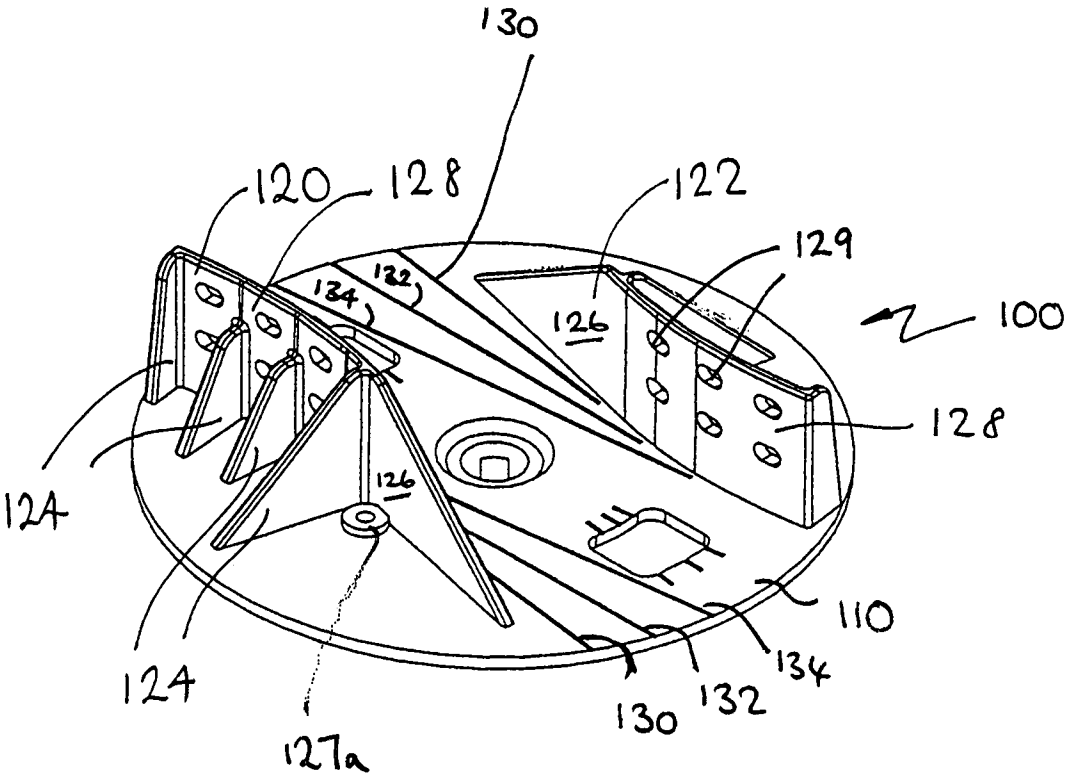
FIG. 2 is a perspective view of a batten support embodying the present invention for use with the pedestal jack of FIG. 1.
Figure 3:
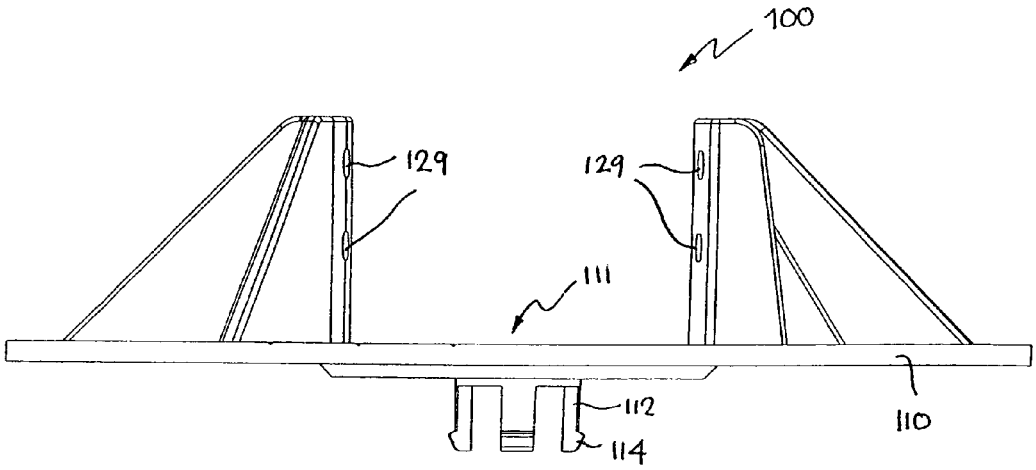
FIG. 3 is a front view of the batten support shown in FIG. 2.
Figure 5:
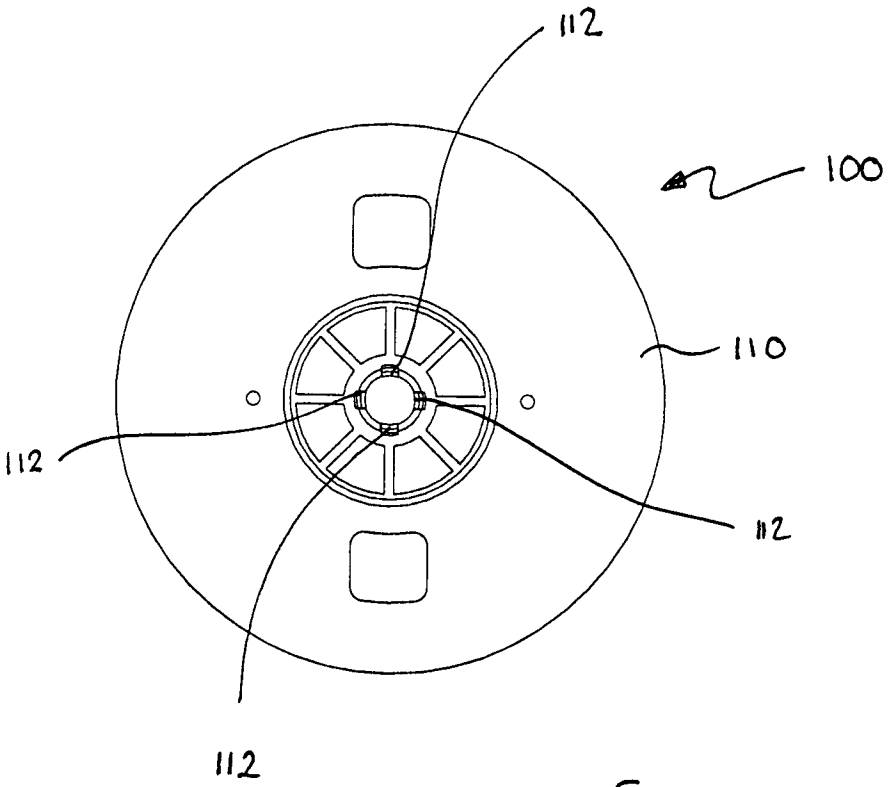
FIG. 5 is an underneath plan view of the batten support shown in FIG. 2.

Turning now to FIG. 2, the joist/batten support or support means 100 includes a generally circular plate 110. The batten support is typically moulded in a plastics material. As is best seen in FIGS. 3 and 5, four legs 112 depend from the underside of the centre 111 of the plate. Short, radially extending Protrusions 114 are defined at the foot of each leg. The legs are disposed around the perimeter of a circle of the same size as the aperture 70 into which they may be snap fitted, by inserting the legs into the aperture 70, with the protrusion being initially deflected inwards by the walls of the aperture then deflecting outwards and engaging the underneath of the wall of the aperture to lock the batten support to the top of the pedestal jack.

Figure 4:
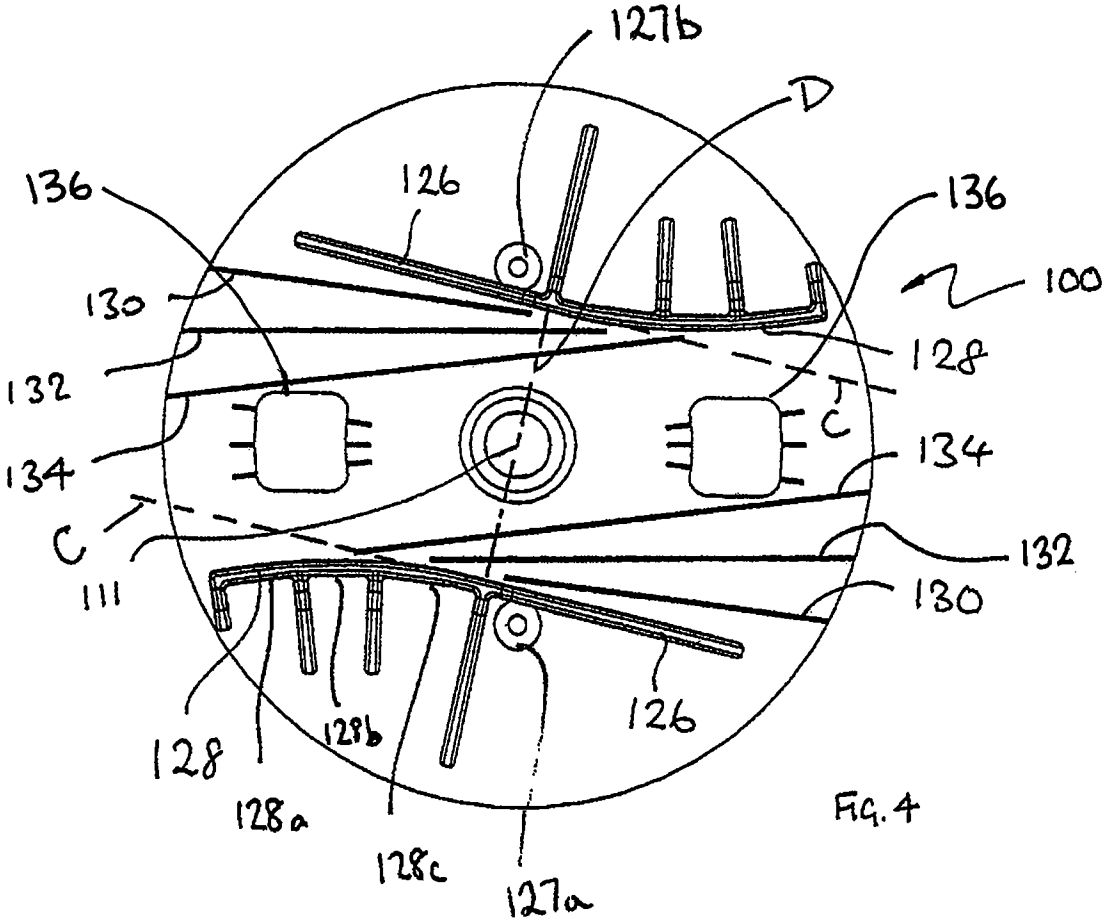
FIG. 4 is a plan view of the batten support shown in FIG. 2.

As is best seen in FIGS. 2 and 4, two opposed upright walls 120, 122 are disposed either side of the centre 111 of the plate. Each wall is supported in an upright position by four buttresses 124. Each wall includes a generally straight portion 126 of gradually increasing height and a curved portion 128 of constant height which also defines a number of holes 129. The holes may receive fasteners such as screws, nails or the like. The holes are elongate in a horizontal direction to accommodate expansion and contraction of the joist supported by the batten. The curved portions are generally convex when viewed from the centre 111 and diverge away from the centre. They are disposed on opposite sides of a notional line D passing through the centre 111 of the plate. The lines are curved such that they diverge away from a notional continuation C of the straight lines 126 shown in dashed lines. The convex/curved portion comprises three sections 128*a*, 128*b*, 128*c* interposed between the buttresses 124, with the distal portion 128*a* having a radius of about 220 mm, the middle portion 152 mm and the innermost portion which is closest to the centre of the plate having a radius of 140 mm. Those dimensions could be varied. It would also be possible to have a curved portion with a constant radius. The convex portion could comprise a series of stepped flats or straight portions rather than a curved wall.

As is best seen in FIG. 4, the batten support is rotationally symmetrical through 180° about the centre of the plate.

Also shown in FIG. 4, are a series of pairs of spaced apart parallel straight lines 130, 132, 134 formed as shallow indentations in the surface of the plate located between the opposed walls and either side of the centre of the plate are two, generally square through apertures 136. The apertures allow the installer to see the top of the slope compensator plate of the pedestal jack to check that the jack is oriented correctly. The perpendicular distance between the lines 130 is greater than that between lines 132 which is in turn greater than that between lines 134.

Also defined in the plate 110 are two holes 127*a*, 127*b* encircled by raised bosses, the holes being disposed adjacent the walls 120, 122 respectively. The holes allow the support to be secured to the compensator plate/head portion of the pedestal 10 using self tapping screws or the like.

Figure 6:
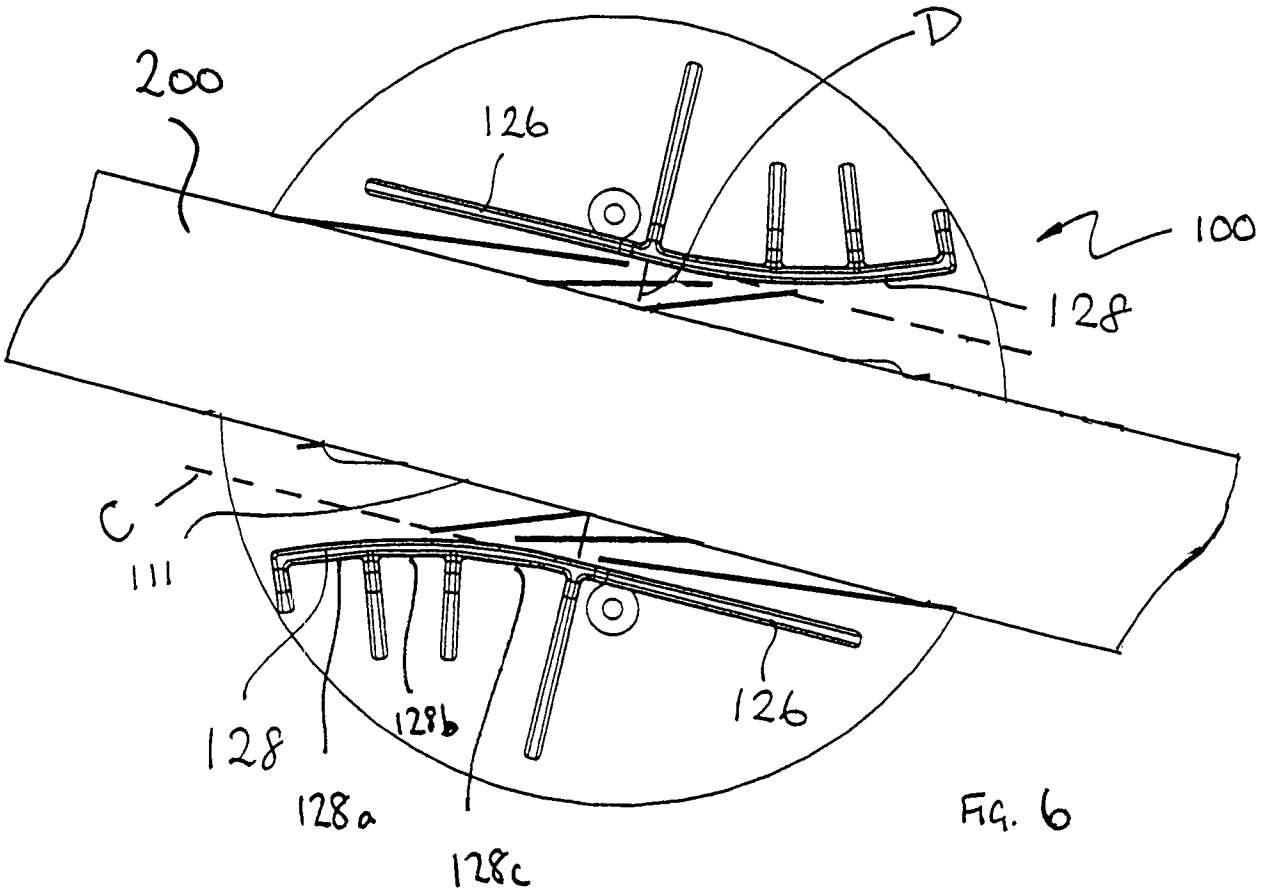
FIG. 6 is a top plan view of the batten support with a joist located thereon.
Figure 7:
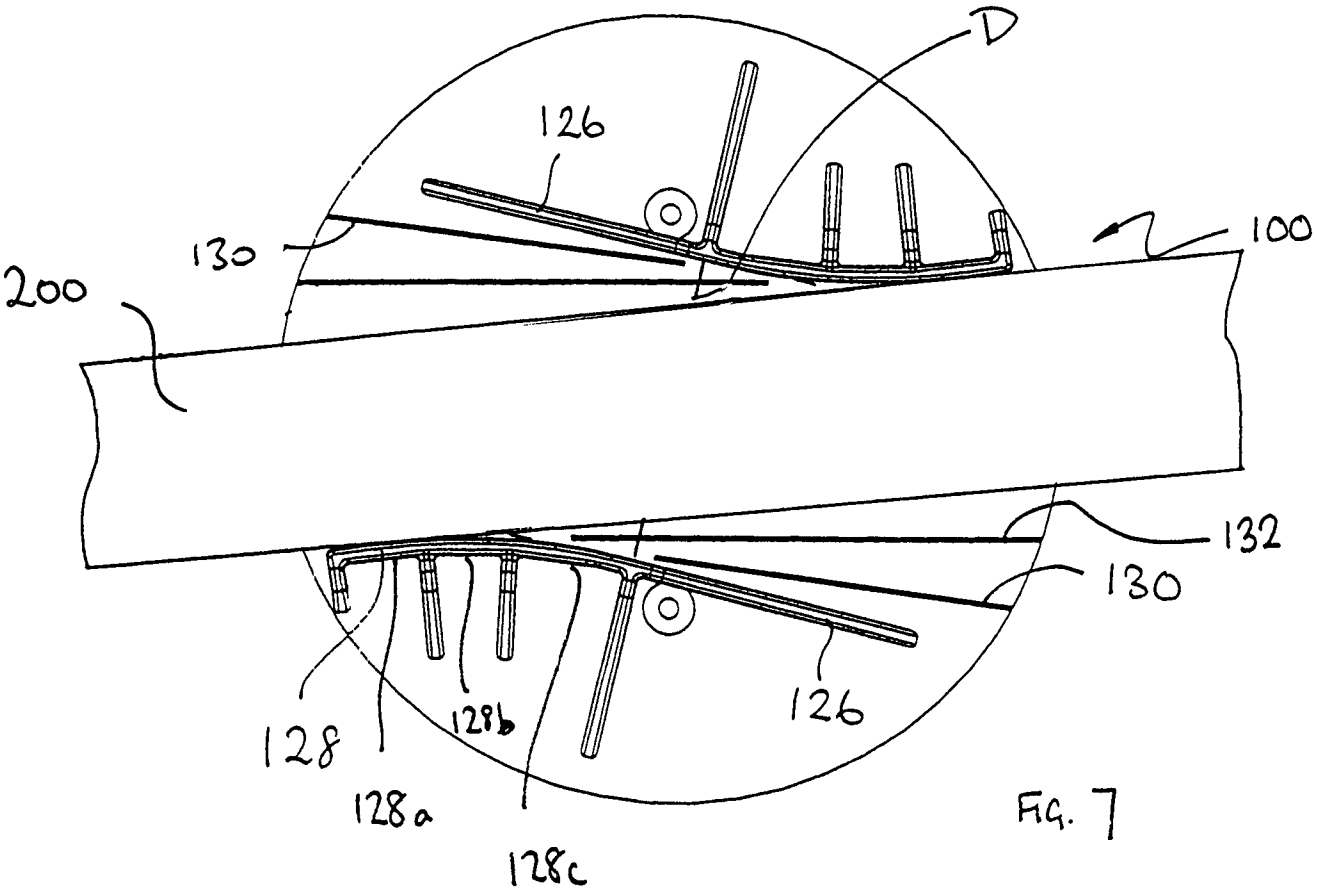
FIG. 7 is a similar view to FIG. 6 after the support has been rotated to engage the joist against the walls of the support.

In use, with reference to FIGS. 4, 6 and 7, the batten support is located on the top of a pedestal jack such as is shown in FIG. 1. The support may be rotated about its centre 111 on the jack. The plate may initially be rotated so that the joist 200 it is to be engaged with is aligned generally in the direction of the straight portions walls 126, as is shown in FIG. 6. When the joist 200 is aligned in that position the perpendicular distance between tangents to the walls 120, 122 is greatest so there is the maximum amount of space to receive the joist/batten 200. Once the joist/batten is inserted between the walls 120, 122, the support 100 is rotated in a clockwise direction about its centre so that the longitudinal edges of the joists move towards lines 130, 132 and 134. Those lines are guide positions for joists of typical thicknesses, 130 being for the widest joists, 134 for the narrowest. Typically the width of the joist will be somewhere between the perpendicular distance between the lines 134 and the perpendicular distance between the lines 132. When the plate is rotated clockwise, the sides of the joist will abut the curved portions 128 of the walls, as shown in FIG. 7. The batten can be secured to the joist by hammering nails into the joist through the apertures 129 in the walls. The support 100 is secured to the pedestal using screws passing through the holes 127*a* and 127*b*.

Figure 8:
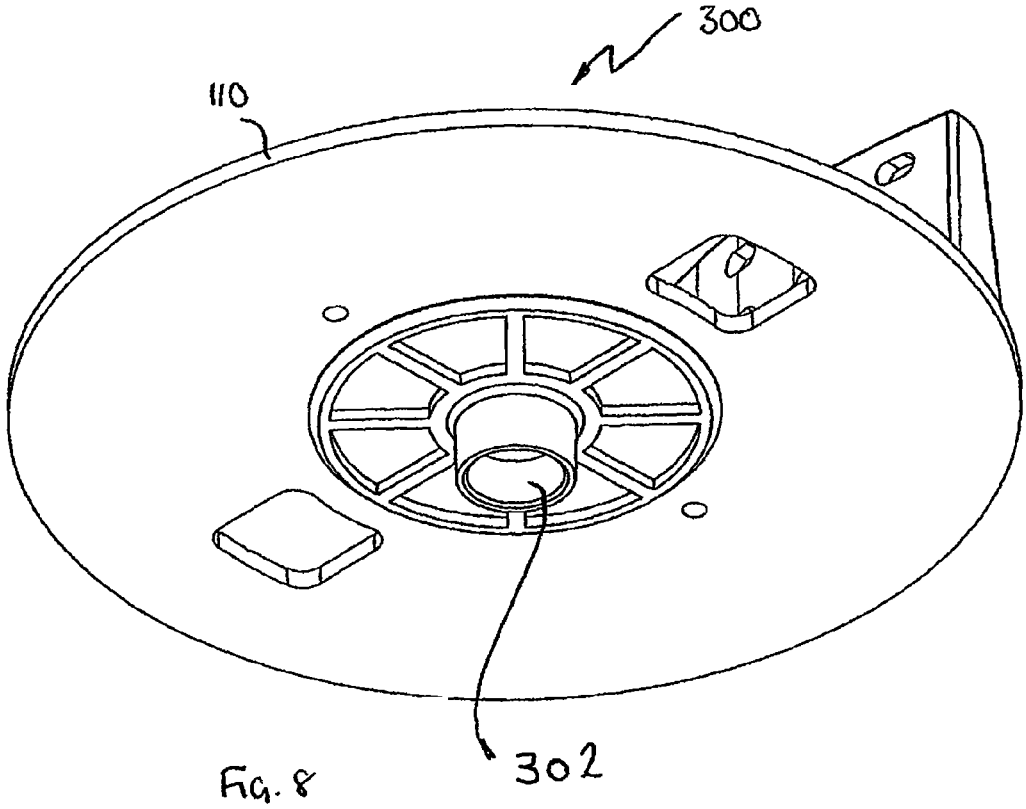
FIG. 8 is an isometric view from underneath of a variant of the batten support which has an alternative design of depending spigot for engagement with the pedestal jack.

FIGS. 8 and 9 show a variant 300 of the batten support 100 of FIGS. 2 to 7. The only difference between the two supports is that the support 300 has an alternative design of depending spigot 302 for engagement with the slope compensator plate of the pedestal jack, instead of the depending legs 112. Those features which are common to those of support 100 are referenced by the same reference numbers. Specifically the depending spigot 302 of support 300 is annular, having a circular cross-section in a plane parallel to the plate 110 of the support.

With reference to FIG. 9, a slope compensator 360 is a variant of that slope compensator 60 shown in FIG. 1, except that instead of having a through hole 70 for receiving the depending legs 112 of the support 100, it defining an annular channel 362 having a circular cross-section for receiving the depending spigot of the support 300. The channel is in the form of a blind bore having a base 364 so that any water which may pass into the channel cannot flow into the pedestal below. The channel 362 is substantially the same size, shape and depth as the depending spigot 302 so that the spigot is a tight fit within the channel.

Although the invention has been described in the context of securing a joist to a batten support located on top of a pedestal jack, it will be appreciated that the principals of the batten support of the present invention may have applications in other areas where engagement of a support with a joist or other elongate member is required.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A support means for engaging a batten, joist or elongate member having a constant width, the support means including a rotatable plate, and further defining means for engaging the support means with a support structure, selected from a group comprising pedestal jacks and pedestal supports, in a manner which allows the support means to be rotated about an axis, the support means further including two opposed upstanding walls defining a gap therebetween for receiving the batten, joist or elongate member, the walls being disposed on either side of the axis and extending from a centermost position closest to the axis to a distal end farthest from the axis, the walls being at least partly convex, wherein the gap between the walls measured in a direction perpendicular to tangents to the walls decreases from the centernost part of the walls to the distal end of the walls, so that for a joist batten or elongate member having a predetermined width and positioned between the walls, rotation of the support means about the axis in one sense causes the walls to tend to abut edges of the joist and in the opposite sense to tend to move away from the edges of the joist; the two opposed upstanding walls including through apertures to receive fasteners including nails or screws, and wherein each wall includes a straight portion which extends from the centremost portion of the walls in an opposite direction to the convex portion of the walls, the straight portions being parallel to each other.

2. A support means as claimed in claim 1 wherein the convex portion is curved.

3. A support means as claimed in claim 1 wherein the radius of the convex portion is greatest at the distal end of the convex portion and least at the centermost portion.

4. A support means as claimed in claim 3 wherein the radius changes continuously.

5. A support means as claimed in claim 1 wherein the plate is generally circular.

6. A support means as claimed in claim 1 wherein the support means defines a depending annular spigot for engaging in a correspondingly shaped blind bore defined in the top of the support structure.

7. A raised floor comprising:

a plurality of raised pedestal jacks;

the support means of claim 1 disposed on the pedestal jacks; and joists attached to and extending between the support means.

8. A method of providing a raised floor using a plurality of support structures;

a plurality of battens, joists, or elongate members; and a plurality of support means for engaging and supporting the batten, joist or elongate members, wherein the support means include a rotatable plate, and further define means for engaging with the support structure in a manner which allows the support means to be rotated about an axis, and wherein the support means further includes two opposed upstanding walls defining a gap therebetween for receiving the batten, joist or elongate member, the walls being disposed on either side of the axis and extending from a centremost position closest to the axis to a distal end farthest from the axis, the walls being at least partly convex, and wherein the gap between the walls measured in a direction perpendicular to tangents to the walls decreases from the centermost part of the walls to the distal end of the walls, so that for a joist, batten or elongate member having a predetermined width and positioned between the walls, rotation of the support means about the axis in one sense causes the walls to tend to abut edges of the joist and in the opposite sense to tend to move away from the edges of the joist and wherein the two opposed upstanding walls include through apertures to receive fasteners including nails or screws, the method comprising the steps of:

providing the plurality of support structures on a subfloor;

mounting support means on top of the support structures, the support means being aligned to allow a batten, joist, or elongate member to be located on the plate between the opposed walls;

rotating the plates to engage the walls of the support means with the batten, joist, or elongate member; and fixing the support means to the batten, joist, or elongate member using fasteners passing through the apertures in the walls.

9. The method of claim 8 wherein each wall of the support structure includes a straight portion which extends from the centermost portion of the walls in an opposite direction to the convex portion of the walls, the straight portions of each wall being parallel to each other.

10. The method of claim 8 wherein the plate is generally circular.

11. The method of claim 8 wherein the support means defines a depending annular spigot for engaging in a correspondingly shaped blind bore defined in the top of the support structure.

* * * * *